US007874070B2

(12) United States Patent
Gunji et al.

(10) Patent No.: US 7,874,070 B2
(45) Date of Patent: Jan. 25, 2011

(54) INJECTION VALVE AND METHOD OF MAKING ORIFICE

(75) Inventors: Kenichi Gunji, Mito (JP); Keiji Kawahara, Hitachinaka (JP); Shuichi Shimizu, Oarai (JP); Atsushi Sekine, Hitachinaka (JP); Masafumi Nakano, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/519,115

(22) Filed: Sep. 12, 2006

(65) Prior Publication Data

US 2007/0057093 A1 Mar. 15, 2007

(30) Foreign Application Priority Data

Sep. 13, 2005 (JP) ..... 2005-264572

(51) Int. Cl.
*B21K 1/22* (2006.01)

(52) U.S. Cl. ..... 29/888.4; 123/470; 123/472

(58) Field of Classification Search ..... 123/472, 123/470, 494, 467; 29/888.02, 888.4, 557; 239/533.2, 533.11

See application file for complete search history.

(56) References Cited

U.S. PATENT DOCUMENTS

| | | | | |
|---|---|---|---|---|
| 4,758,169 | A | 7/1988 | Steiger | |
| 4,971,014 | A * | 11/1990 | Usui | 123/470 |
| 5,636,319 | A * | 6/1997 | Glucksman et al. | 392/406 |
| 5,934,571 | A | 8/1999 | Schmidt et al. | |
| 6,845,748 | B2 | 1/2005 | Kobayashi et al. | |
| 6,976,381 | B2 * | 12/2005 | Koshizaka et al. | 72/341 |
| 7,234,654 | B2 | 6/2007 | Holzgrefe et al. | |
| 2003/0111562 | A1 | 6/2003 | Stier et al. | |
| 2004/0000601 | A1 | 1/2004 | Niwa | |
| 2004/0046064 | A1 | 3/2004 | Shiraishi et al. | |
| 2005/0139801 | A1 * | 6/2005 | Ott | 251/359 |
| 2006/0226263 | A1 | 10/2006 | Holzgrefe et al. | |

FOREIGN PATENT DOCUMENTS

| | | | |
|---|---|---|---|
| DE | 102 14 906 | A1 | 2/2004 |
| EP | 0 234 314 | A2 | 9/1987 |
| EP | 0 918 155 | A2 | 5/1999 |

(Continued)

OTHER PUBLICATIONS

Extended European Search Report dated Feb. 8, 2007 including Information Concerning the Extended European Search Report According to New Rule 44(a)(1) (ten (10) pages).

(Continued)

*Primary Examiner*—Stephen K Cronin
*Assistant Examiner*—J. Page Hufty
(74) *Attorney, Agent, or Firm*—Crowell & Moring LLP

(57) ABSTRACT

An injection valve has a nozzle body, a valve needle positioned in the nozzle body, an actuator for actuating the valve needle, and an orifice plate fixed at an end of the nozzle body. The orifice plate has a valve seat for cooperating with the valve needle and an orifice for injecting a fluid. The orifice plate is provided with a projection having a convex-curved surface on an orifice outlet side of the orifice plate. A flat surface portion is formed in the area of the convex-curved surface, and the outlet of the orifice is located in the flat surface portion.

10 Claims, 7 Drawing Sheets

FOREIGN PATENT DOCUMENTS

| | | | |
|---|---|---|---|
| EP | 1 283 336 | A2 | 2/2003 |
| JP | 7-63140 | A | 3/1995 |
| JP | 2001-096196 | A | 4/2001 |
| JP | 2003-049751 | | 2/2003 |
| JP | 2003-505645 | | 2/2003 |
| JP | 2003-254194 | | 9/2003 |
| JP | 2005-220774 | | 8/2005 |
| JP | 2005-220774 | A | 8/2005 |
| JP | 2006-510849 | | 3/2006 |
| WO | WO 2004/109094 | A1 | 12/2004 |

OTHER PUBLICATIONS

Japanese Non-final Office Action of JP 2005-264572 dated Jun. 23, 2009.

* cited by examiner

INJECTION VALVE AND METHOD OF MAKING ORIFICE

CLAIM OF PRIORITY

The present application claims priority from Japanese application serial No. 2005-264572 filed on Sep. 13, 2005, the content of which is hereby incorporated by reference into this application.

1. FIELD OF THE INVENTION

The present invention relates to an injection valve for injecting a fluid, and more particularly, to an orifice for determining a flow rate, an orifice making method and an injection valve using the orifice.

2. BACKGROUND OF THE INVENTION

In fuel injection valves, conventional art where an orifice (injection hole) is provided in spherical projection by press working is disclosed in Japanese Patent Laid-Open No. Hei 7-63140. The injection hole is formed by making an injection hole in a flat plate by press working or the like and by drawing a peripheral portion of the injection hole in a dome shape.

Further, as an processing method of deflected orifice in nozzle body manufacturing, press working disclosed in Japanese Patent Laid-Open No. 2001-96196 is known. In the processing method of deflected orifice disclosed in the Patent publication, a flat surface vertical to the axis of an orifice is provided in a blank in advance, and positioning is made at right angle to the flat surface and the orifice is made by extruding from the downstream side. Next, the upstream side is subjected to machining and a full shear plane is obtained.

However, the prior art disclosed in Japanese Patent Laid-Open No. Hei 7-63140 is perforation by injection hole press working or drilling and by drawing around the hole. According to such a hole processing, as the injection hole is tapered, it is difficult to obtain a cylindrical orifice. Further, upon drawing, as the orifice is taper-deformed, the injection hole precision upon perforation cannot be maintained without difficulty. Accordingly, it is extremely difficult to obtain a μm-order precision injection hole.

Further, in the prior art disclosed in Japanese patent Laid open No. 2001-96196, when an orifice deflected from the axis of an injection valve is made, it is necessary to provide a flat surface vertical to an orifice processing axis in a blank in advance. Upon orifice processing, it is necessary to position the orifice processing axis at right angle to the flat surface. As a result, a mark for positioning is required, and expensive equipment for image recognition or the like for positioning is required. Further, it takes much time for positioning, thus the productivity is seriously decreased.

Further, it is impossible to process plural orifices in deflection directions different from each other.

SUMMARY OF THE INVENTION

To solve the above problems, the present invention has an object to provide an injection valve where a flat surface portion vertical to the axis of an orifice is provided in a spherical projection on the downstream side of the orifice, and the orifice is formed in the flat surface portion, thereby homogeneity of spray is improved. Further, the invention has another object to provide a method for easily processing an orifice deflected in one or more directions.

One representative injection valve according to the present invention comprises:

a nozzle body, a valve needle positioned in the nozzle body, an actuator for actuating the valve needle, and an orifice plate fixed at an end of the nozzle body, having a valve seat for cooperate with the valve needle and an orifice for injecting a fluid, wherein the orifice plate is provided with a projection having a convex-curved surface on an orifice outlet side of the orifice plate, a flat surface portion is formed in the area of the convex-curved surface, and the outlet of the orifice is located in the flat surface portion.

Further, one representative orifice making method according to the present invention comprises:

a step of preparing a blank where a convex-curved surface portion is formed around an outlet of the orifice, a step of forming a positioning hole for the orifice on an outside of the convex-curved surface portion, a step of forming a flat surface portion, at an approximately right angle to an axis of the orifice, in an area of the convex-curved surface portion, and then a step of making the orifice in the flat surface portion.

According to the present invention, an injection valve with improved spray homogeneity can be provided.

DETAILED DESCRIPTION OF THE PREFERRED EMBODIMENTS

Hereafter, embodiments of the present invention will be described in detail with reference to the drawings.

Embodiment 1

Figure 1:
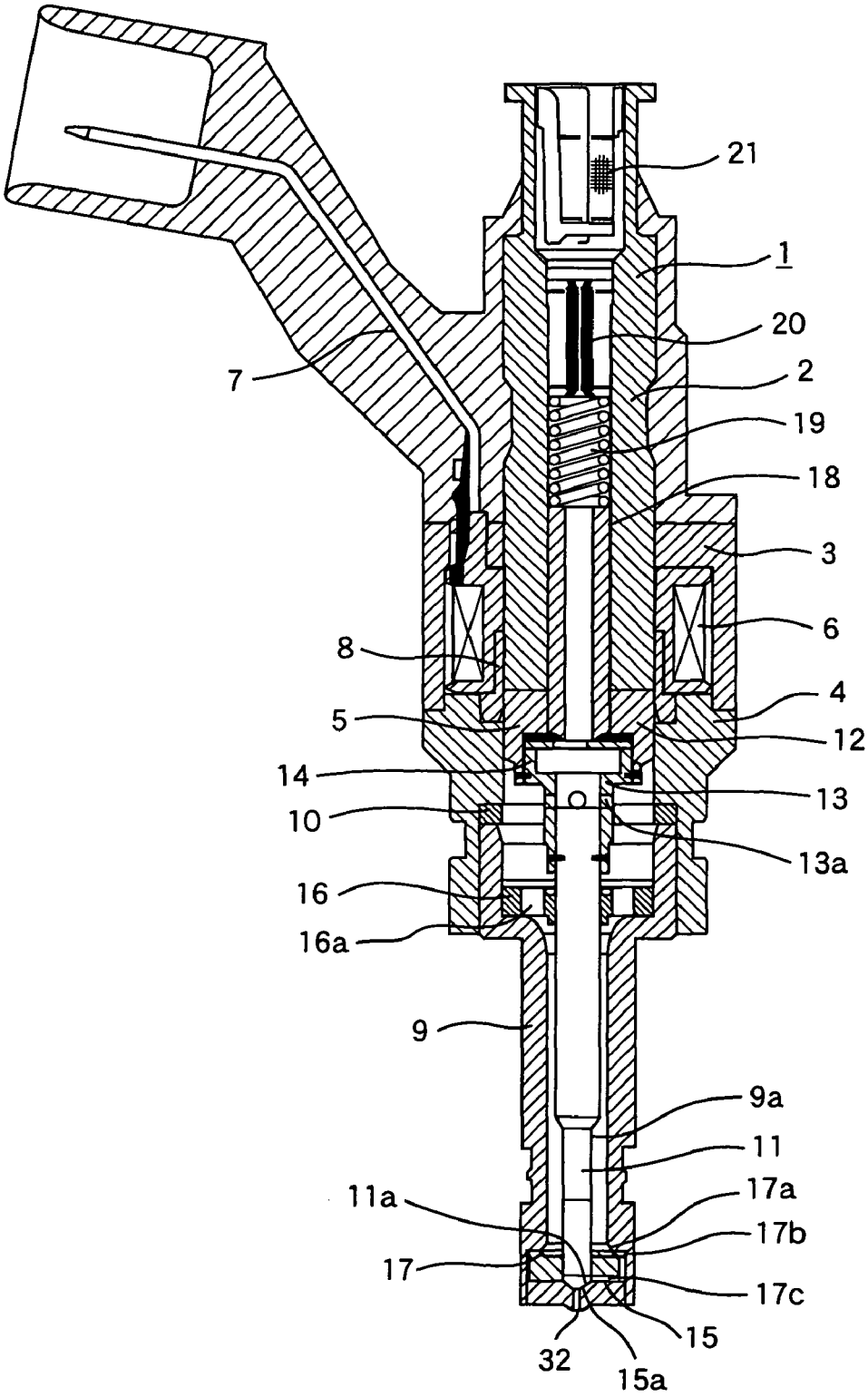
FIG. 1 is a longitudinal sectional view showing the entire structure of the injection valve showing the first embodiment of the present invention.

FIG. 1 is a longitudinal sectional view showing the entire structure of an injection valve according to an embodiment of the present invention.

An injection valve 1 has a magnetic circuit including a stationary core 2, a yoke 3, a housing 4 and a movable element 5, a coil 6 for exciting the magnetic circuit, and a terminal bobbin 7 to energize the coil 6. A seal ring 8 is interposed between the core 2 and the housing 4 so as to prevent inflow of fluid such as fuel into the coil 6.

Valve parts are positioned in the housing 4. The movable element 5, a nozzle body 9 and a ring 10 for regulating a stroke of the movable element 5 are arranged. The movable element 5 is a combination of a valve needle 11 and a movable core 12 with a joint 13. A plate 14 for suppressing rebound of the movable element 5 at valve closing, in cooperation with a pipe 18, is provided between the movable core 12 and the joint 13.

The housing 4 and the nozzle body 9 are joined to each other, and they construct an external cylindrical member for covering around the movable element 5. The nozzle body 9 is provided with an orifice plate 15 and a swirler 17. The orifice plate has a seat surface 15*a* (valve seat) and an orifice 32 at its end. The swirler 17 is to apply a swirling force for the fuel and to slidably guide the movable element 5 along with a guide plate 16. The nozzle body 9, the orifice plate 15 and the swirler 17 may be separate members, or may be integrated with each other.

A spring 19 for exerting the valve needle 11 toward the seat surface 15*a* via the pipe 18 and the plate 14, an adjuster 20 for adjusting a pressing load on the spring 19, and a filter 21 for preventing extraneous contamination are provided inside the stationary core 2.

Next, the operation of the above injection valve 1 will be described in detail.

When the coil 6 is energized, the movable element 5 is lifted in the direction of the stationary core 2 against a biasing force of the spring 19, and thus a gap is formed between the needle head 11*a* at the end of the movable element 5 and the seat surface 15*a* (valve open state). The pressurized fuel first enters the nozzle body 9 via the core 2, the adjuster 20, the pipe 18 and a fuel passage 13*a* in the movable element 5. Next, the fuel enters passages 17*a* and 17*b* of the swirler 17 from a fuel passage 16*a* of the guide plate 16 and a passage 9*a* of the nozzle body, and a swirling force is applied to the fuel by a swirl groove 17*c* of the swirler 17. The swirling-force applied fuel is injected through an orifice 32 from the gap between the needle head 11*a* and the seat surface 15*a*.

On the other hand, when an electric current through the coil 6 is broken, the needle head 11*a* of the movable element 5 is brought into contact with the seat surface 15*a* with the force of the spring 19, thus the valve is in a valve closed state.

Next, a manufacturing method of the orifice plate 15 and the orifice 32 of the above injection valve 1 will be described in detail.

Figure 2:
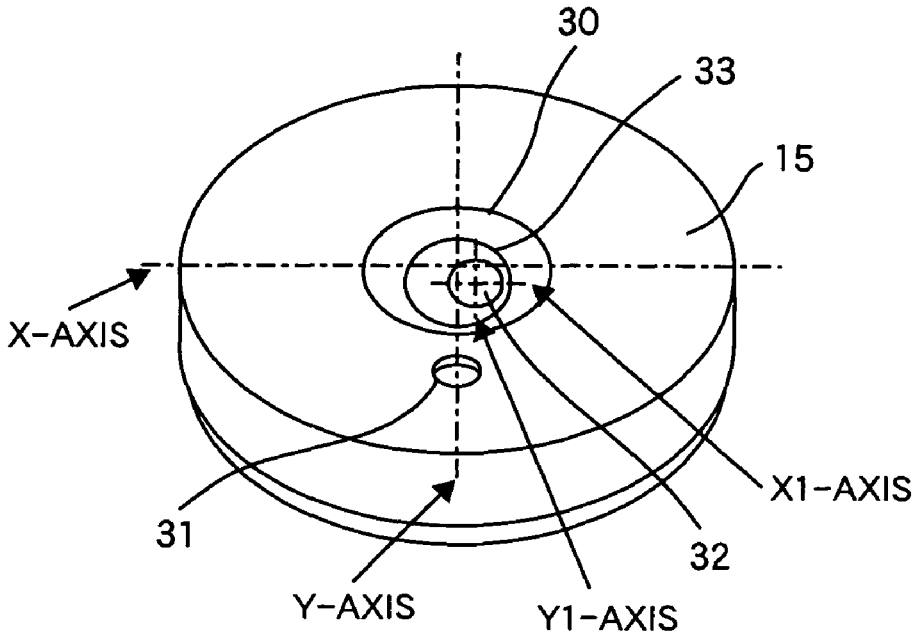
FIG. 2 is a perspective view of the orifice plate showing the first embodiment of the present invention.
Figure 3:
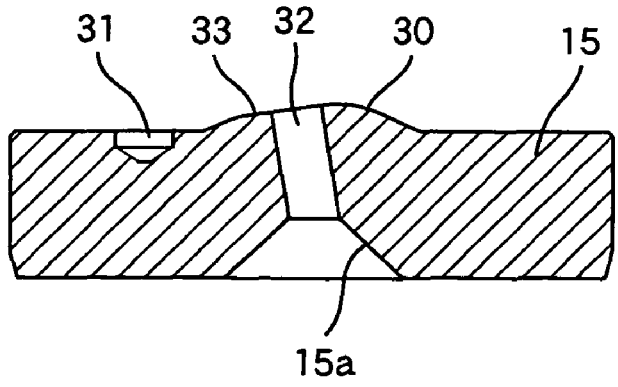
FIG. 3 is a longitudinal sectional view of the orifice plate showing the first embodiment of the present invention.

FIGS. 2 and 3 show a first embodiment of the present invention. FIG. 2 is a perspective view of the orifice plate 15. FIG. 3 is a longitudinal sectional view of FIG. 2 cut along a Y-axis.

The orifice plate 15 has a spherical projection 30 to be a convex-curved surface at the center of its end surface. A flat surface portion 33 slanted toward a positioning hole 31 is at a right angle to an axis of the orifice 32. The orifice 32 is slanted with respect to an axis of the fuel injection 5 valve 1, and is opened at right angles to the flat surface portion 33. The outlet side-end face of the orifice 32 is a flat end face. Further, the seat surface 15*a* having an approximately conical shape is provided on the upstream side of the orifice 32

When the orifice 32 is at right angles to the flat surface portion 33 as shown in FIG. 3, as long as the position of the orifice 32 is within the flat surface portion 33, no problems occurs in processing even when a central axis X1-Y1 of the orifice 32 is deflected from a central axis X-Y of the orifice plate 15 as shown in FIG. 2.

In the above arrangement, as the outlet of the orifice is in a plane at right angle to the axis of the orifice, the injection timing of fluid becomes the same in the entire perimeter. Even in the case of an orifice deflected from the axis of an injection valve, the length of penetration can be uniformed, thus the homogeneity of spray can be improved.

FIGS. 4 and 5 show processing steps of the orifice plate 15. FIG. 4 shows perspective views of the respective steps. FIG. 5 shows longitudinal sectional views.

Figure 4A:
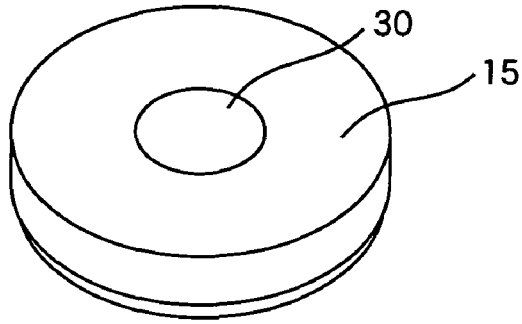
FIG. 4 is perspective views of steps of processing of the orifice plate showing the first embodiment of the present invention.
Figure 4B:
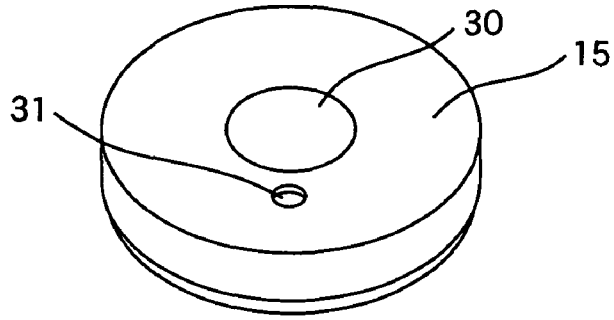
Figure 4C:
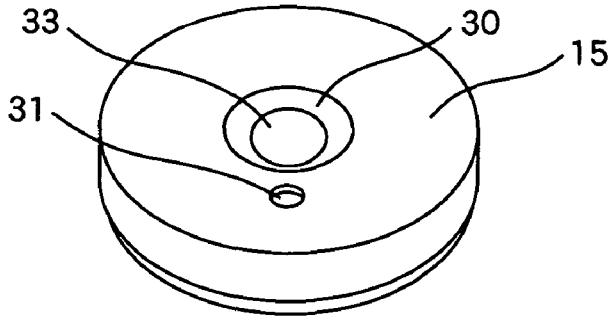
Figure 4D:
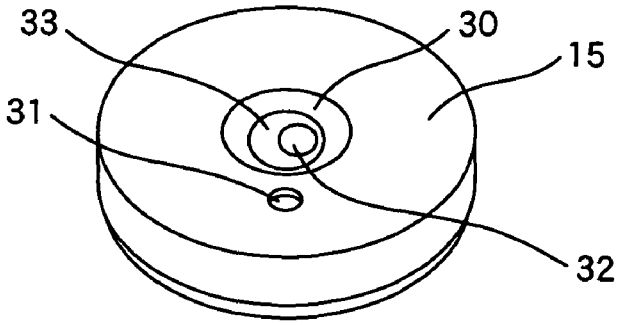
Figure 5A:
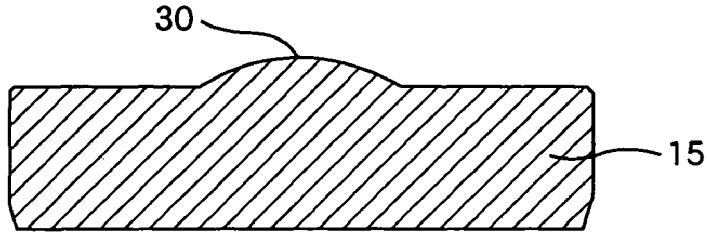
FIG. 5 is longitudinal sectional views of steps of processing of the orifice plate showing the first embodiment of the present invention.
Figure 5B:
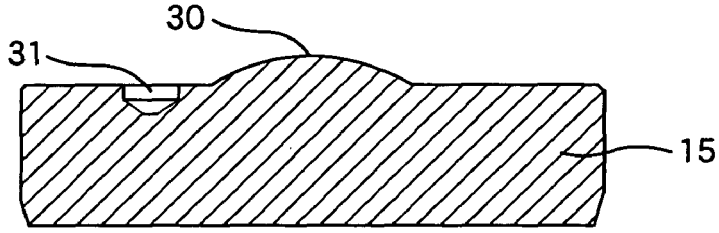
Figure 5C:
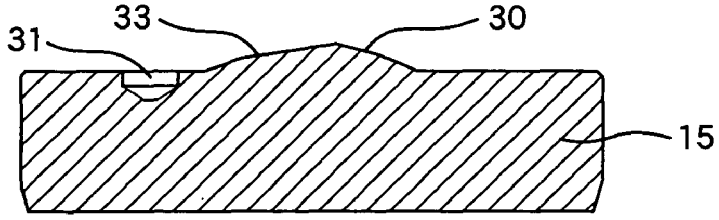
Figure 5D:
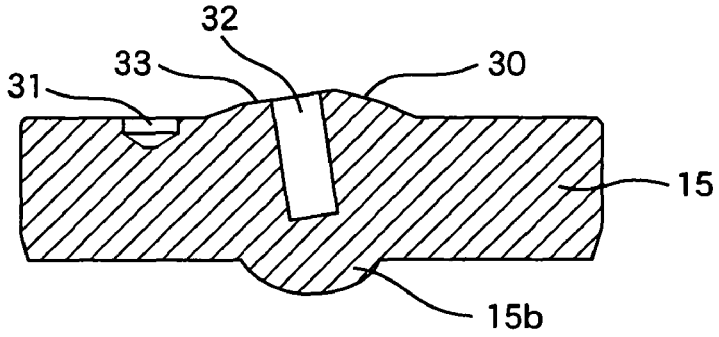

FIG. 4(I) and FIG. 5(I) show a blank having a spherical projection 30 at the center of an end surface of the orifice plate 15, formed by cutting or press working, or forging.

FIG. 4(II) and FIG. 5(II) show the processed positioning hole 31 formed by press working or lathe turning, or cutting or electric discharge machining.

FIG. 4(III) and FIG. 5(III) show the processed flat surface portion 33, processed to be at approximately a right angle to the axis of the orifice 32. The processing is made by press working, lathe turning or cutting, or electric discharge machining.

FIG. 4(IV) and FIG. 5(IV) show the processed orifice 32. In the case of press working to the orifice, an inner surface thereof can be formed in a full shear plane by pouch-shape processing, and the surface roughness can be greatly improved. Note that as shown in FIG. 3, an extruded portion 15*b* occurred at press working is cut upon processing of the seat surface 15*a* (valve seat). In the case of lathe turning, cutting or electric discharge machining, it may be arranged such that the seat surface 15*a* is processed in a blank state in advance then the orifice 32 is processed.

Figure 6A:
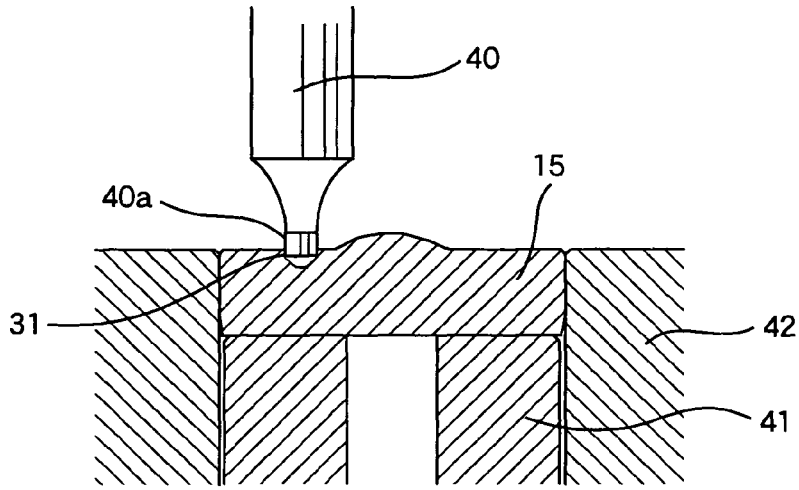
FIG. 6 is longitudinal sectional views of steps of press working of the orifice plate showing the first embodiment of the present invention.
Figure 6B:
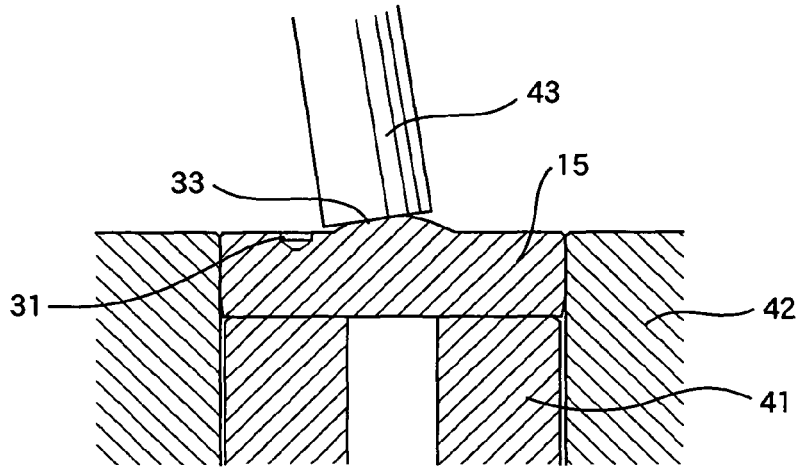
Figure 6C:
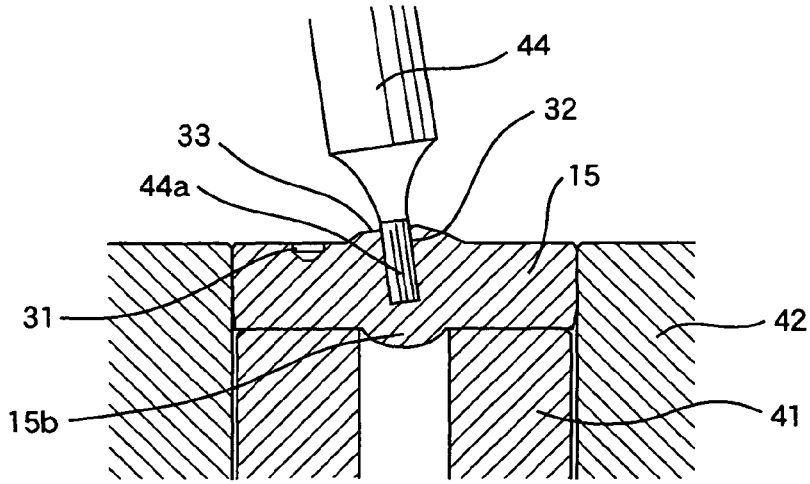

FIG. 6 shows the press working as an example of processing method for the orifice plate.

FIG. 6(I) shows a step of processing of the positioning hole 31. The orifice plate 15 is placed on the upper surface of a die 41, and its outer diameter is firmly held with a collet chuck 42. Next, the positioning hole 31 is processed by pressing with a positioning hole processing unit 40*a* of a punch 40 while the orifice plate 15 is held. The processing of the positioning hole 31 may be executed by coining processing.

FIG. 6 (II) shows a step of processing of the flat surface portion 33. The flat surface portion 33 is processed by pressing the flat surface portion 33 with a punch 43 while the orifice plate 15 is held with a collet chuck 42. The processing of the flat surface portion may be executed by coining processing and surface hardening processing.

FIG. 6(III) shows a step of processing of the orifice 32. A cutting blade 44*a* of a punch 44 is pressed at a right angle against the flat surface portion 33 thereby the orifice 32 is extruded in a pouch shape. At this time, as the orifice plate 15 is held with the collet chuck 42, the flat surface portion 33 and the orifice 32 can be processed with high positional precision with reference to the positioning hole 31. Further, positioning is not necessary. The processing of the orifice 32 may be executed by extruding, half blanking, or stamping.

As described above, as a flat surface portion is provided at a right angle to the axis of an orifice in the area of a spherical projection and the orifice is press-processed against the flat surface portion at a right angle, a bending force is not applied to the punch, and breakage of the punch can be prevented. A deep hole having an aspect ratio of 2 or higher can be easily processed even in martensite stainless steel with carbon content of 0.25% or higher (for example, SUS420J2). When martensite stainless steel with carbon content of 0.25% or higher is used, it is more desirable that the quenched hardness is equal to or higher than HRC 52.

Further, in the case of lathe turning or electric discharge machining, as a drill or electrode can be applied at a right angle to a processed surface, the drill or electrode can be prevented from being positionally shifted due to slipping. Thus the orifice can be easily processed with high precision.

Embodiment 2

Figure 7:
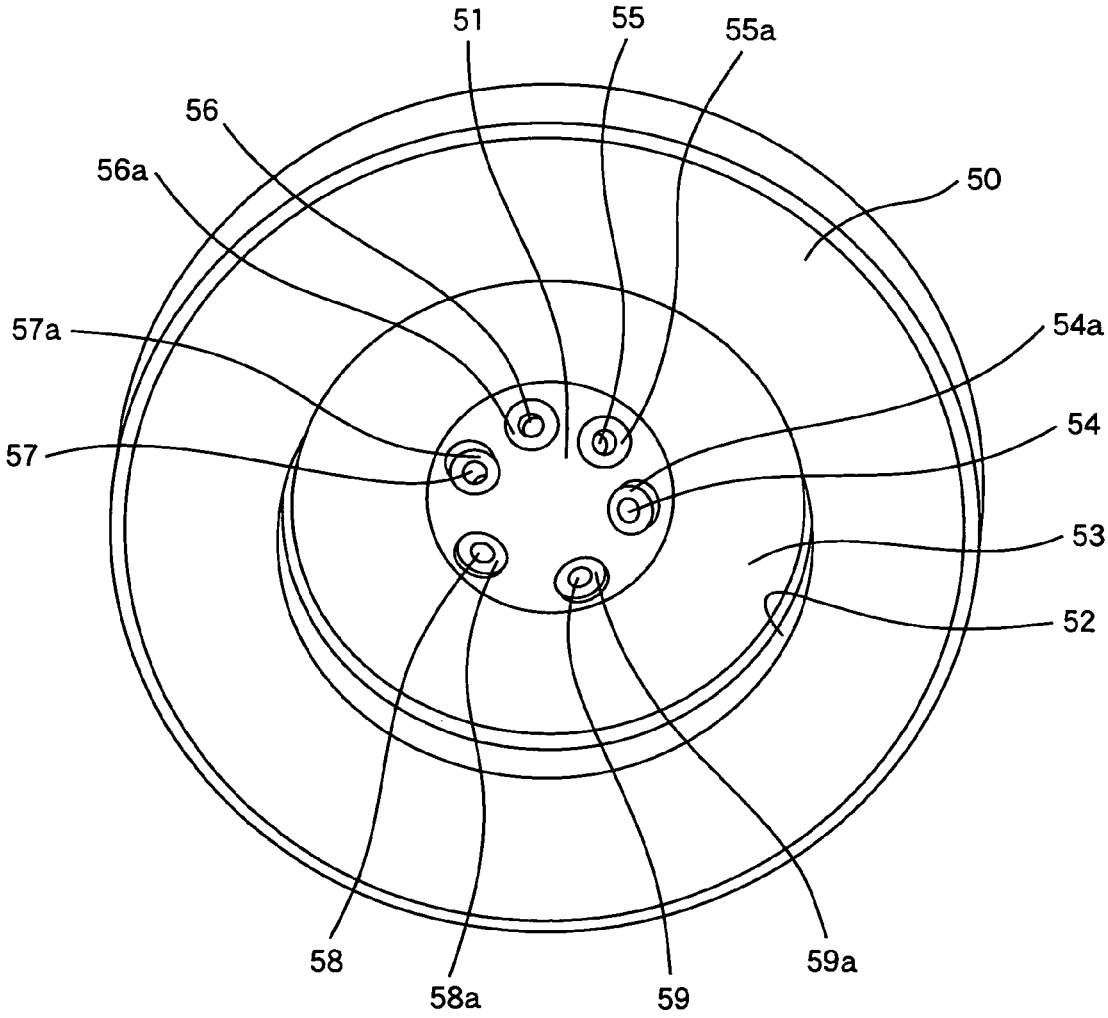
FIG. 7 is a perspective view of the orifice plate having plural orifices showing the second embodiment of the present invention.

FIG. 7 shows an example where six orifices 54, 55, 56, 57, 58 and 59 as plural orifices are made in an orifice plate 50. The downstream side of the orifice plate 50 has a concave portion formed by an inner wall 52 and an inner bottom 53. A spherical projection 51 is formed in the area of an inner bottom 53.

In the spherical projection 51, the respective orifices 54, 55, 56, 57, and 58 are opened in different directions, and flat surface portions 54*a*, 55*a*, 56*a*, 57*a*, 58*a* and 59*a* around the respective orifices are formed at right angles to the axes of the respective orifices. In other words, the orifices 54, 55, 56, 57, 58 and 59 are made at right angles to the respective flat surface portions, and outlets of the respective orifices are opened in the respective flat surface portions.

In the flat surface portions 54*a*, 55*a*, 56*a*, 57*a*, 58*a* and 59*a*, as long as portions where the orifices 54, 55, 56, 57, 58 and 59 are opened are flat surfaces at minimum, there is no problem in processing of the orifices 54, 55, 56, 57, 58 and 59.

As described above, orifices having different injection directions can be easily processed with high precision, especially by press working, lathe turning, electric discharge machining or the like, by providing plural flat surface portions respectively at right angles to the axes of plural orifices in a spherical projection on the orifice downstream side.

Embodiment 3

Figure 8:
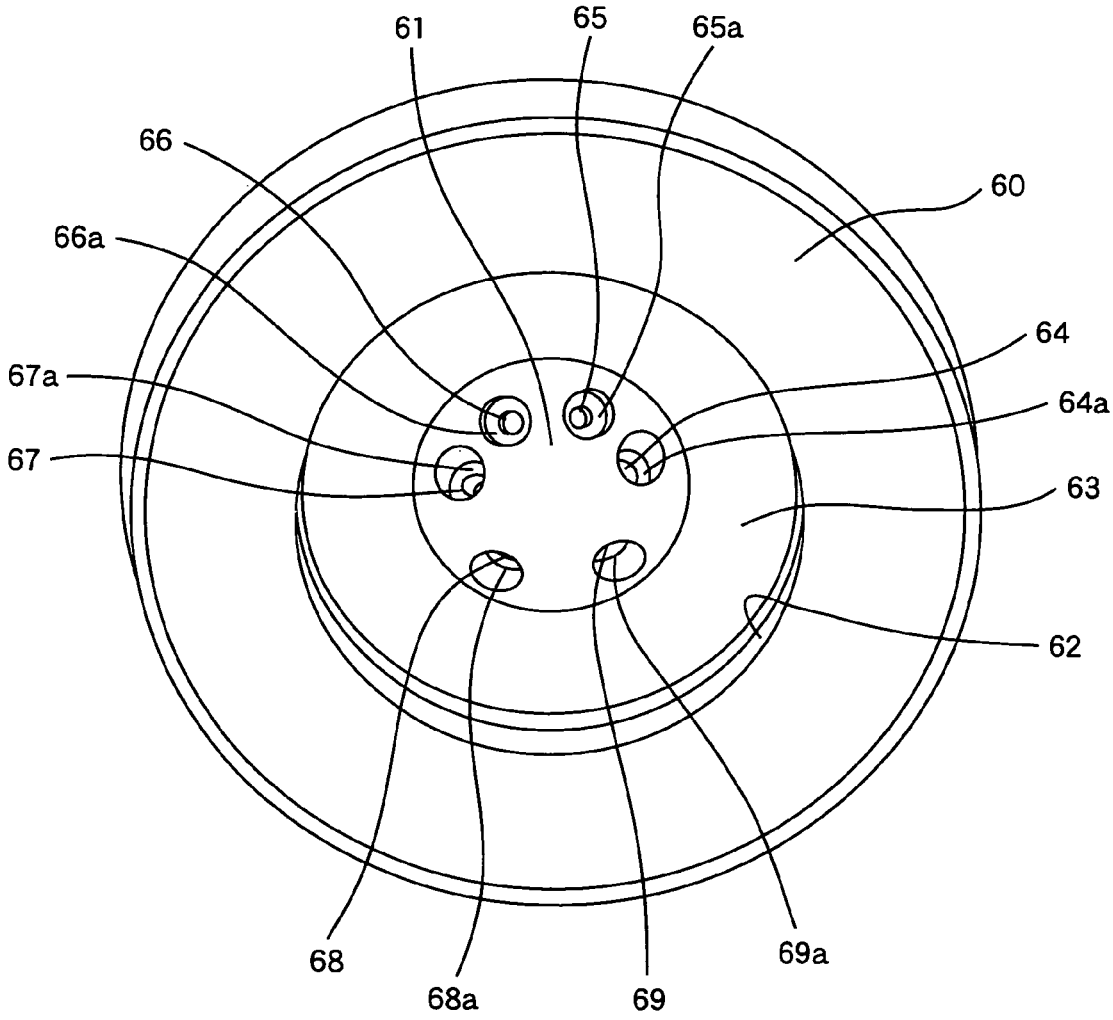
FIG. 8 is a perspective view of the orifice plate having plural orifices showing the third embodiment of the present invention.

FIG. 8 shows an example where six orifices 64, 65, 66, 67, 68 and 69 as plural orifices having different lengths from to each other are made in an orifice plate 60. The downstream side of the orifice plate 60 has a concave portion formed by an inner wall 62 and an inner bottom 63. A spherical projection 61 is formed in the area of an inner bottom surface 63.

The respective orifices 64, 65, 66, 67, 68 and 69 are opened in different directions, and the outlets of the orifices are positioned in the respective hollows provided in the area of the spherical projection 61. The inner bottoms of the hollows are respectively formed with flat surface portions 64*a*, 65*a*, 66*a*, 67*a*, 68*a* and 69*a*. The flat surface portions 64*a*, 65*a*, 66*a*, 67*a*, 68*a* and 69*a* are formed at right angles to the axes of the respective orifices in the area of the spherical projection 61. The orifices 64, 65, 66, 67, 68 and 69 are made at right angles to the respective flat surface portions 64*a*, 65*a*, 66*a*, 67*a*, 68*a* and 69*a*, and the outlets of them are positioned in the respective flat surface portions.

In order to set the lengths of the orifices 64, 65, 66, 67, 68 and 69 to optimum lengths in consideration of spray shape and processing characteristics, the depths of the flat surface portions 64*a*, 65*a*, 66*a*, 67*a*, 68*a* and 69*a* in the hollows are appropriately changed.

In this manner, the orifice lengths can be changed by providing hollow-flat surface portions at right angles to the axes of the orifices in the spherical projection on the orifice downstream side and by changing depths of the hollow- flat surface portions. Thus the spray shape and processing characteristics can be improved.

According to the respective embodiments of the present invention, as a flat surface portion is provided at right angle to the axis of an orifice in a spherical projection on the orifice downstream side and the orifice is formed in the flat surface portion, the outlet of the orifice is positioned in a surface at a right angle to the axis of the orifice, and fluid injection timing is the same in the entire perimeter. Even in an orifice deflected from the axis of an injection valve, the penetration length can be uniformed, and the homogeneity of spray is improved.

Further, the orifice length can be changed by providing a hollow-flat surface portion at a right angle to the axis of the orifice in the spherical projection on the orifice downstream side and changing the depth of the hollow-flat surface portion, thus spray shape can be optimized.

Further, the orifice can be easily processed with high precision especially by press working, lathe turning, electric discharge machining or the like, by providing a flat surface portion at a right angle to the axis of the orifice in the spherical projection on the orifice downstream side and by forming the orifice in the flat surface portion.

Further, orifices having different injection directions can be easily processed with high precision especially by press working, lathe turning, electric discharge machining or the like, by providing plural flat surface portions at right angles to the axes of the orifices in the spherical projection on the orifice downstream side.

Further, an orifice can be positioned with high precision and efficiency by performing positioning and processing of a flat surface at a right angle to the axis of the orifice (especially an orifice deflected from the axis of an injection valve or plural orifices) while a blank is chucked.

The respective embodiments of the present invention have been described particularly as above, however, the present invention is not limited to these examples, but various changes can be made within the scope of the idea of the present invention. For example, in the above embodiment, the area where the flat surface portion 33 is formed is the spherical projection 30, however, the area may have other curved shape than the spherical surface (convex-curved surface portion).

Further, the injection valve of the present invention is applicable to other fluid than the fuel, e.g., water, processing oil, oil paint, ink and gaseous matter.

What is claimed is:

1. A method of making an orifice of an injection valve for injecting a fluid, the orifice being slanted with respect to an axis of the injection valve, comprising:

a first press working process step of forming a flat surface portion by press working in an area of a convex-curved surface portion, which is formed on a blank to be worked, and a second press working process step of making the orifice at the flat surface portion after the first press working process step so that an axis of the orifice has an approximately right angle to the flat surface portion and an outlet of the orifice is formed, in an area of the flat surface portion, by press working the blank with a punch from the flat surface toward a side opposite to the convex-curved surface portion.

2. The method according to claim 1, further comprising forming a valve seat by lathe turning the upstream side of the orifice in the blank after the first and second press working process steps.

3. The method according to claim 2, further comprising a third press working process step of making a positioning hole on a surface of the blank by working-pressing, wherein the surface is the same side as the convex-curved portion, wherein the blank is chucked but not released while the third press working process step, the first press working process step, and the second press working process step are executed, wherein the second press working process step is executed by half blanking with extruding, and wherein an extruded portion derived from the extruding is eliminated by forming the valve seat.

4. The method according to claim 1, wherein the blank is a martensite stainless steel member having a carbon content of 0.25% or higher and a quenched hardness equal to or higher than HRC 52.

5. The method according to claim 1, wherein the flat surface portion is formed as a bottom of a hollow formed in the convex-curved surface portion.

6. The method according to claim 1, wherein the flat surface portion is one of plural flat surface portions and the orifice is one of plural orifices that are made by the first and second press working process steps.

7. The method according to claim 6, wherein each orifice is made for each flat surface portion at the second press working process step after the first press working process step, thereby forming plural flat surface and orifice pairs.

8. The method according to claim 3, wherein the first, second and third press working process steps are executed in the order of the third press working process step, the first press working process step, and the second press working process step.

9. The method according to claim 1, wherein the flat surface portion is hardened by surface hardening processing of the first press working process step.

10. The method according to claim 1, wherein the blank is chucked but is not released while the first press working process step and the second press working process step are executed.

* * * * *